US006424100B1

(12) United States Patent
Kominami et al.

(10) Patent No.: US 6,424,100 B1
(45) Date of Patent: Jul. 23, 2002

(54) FLUORESCENT LAMP OPERATING APPARATUS AND COMPACT SELF-BALLASTED FLUORESCENT LAMP

(75) Inventors: Satoshi Kominami; Koji Miyazaki, both of Osaka; Mamoru Takeda, Kyoto; Takayuki Imai, Osaka; Masayoshi Gyoten, Shiga; Masanobu Murakami, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 68 days.

(21) Appl. No.: 09/692,214

(22) Filed: Oct. 20, 2000

(30) Foreign Application Priority Data

Oct. 21, 1999 (JP) ..... 11-299630

(51) Int. Cl.[7] ..... H05B 37/02
(52) U.S. Cl. ..... 315/307; 315/224; 315/309
(58) Field of Search ..... 315/307, 308, 315/309, 224

(56) References Cited

U.S. PATENT DOCUMENTS 5,485,061 A 1/1996 Ukita et al.
6,087,787 A * 7/2000 Williams ..... 315/307

FOREIGN PATENT DOCUMENTS

| | | |
|---|---|---|
| EP | 0 774 885 A1 | 5/1997 |
| JP | 55-093658 | 7/1980 |
| JP | 59-101797 | 6/1984 |
| JP | 62-033161 | 2/1987 |
| JP | 03-053798 | 5/1991 |
| JP | 05-036483 | 2/1993 |
| JP | 06-295791 | 10/1994 |
| JP | 07-065984 | 3/1995 |
| JP | 09-204989 | 8/1997 |
| TW | 343031 | 10/1998 |

* cited by examiner

*Primary Examiner*—David Vu
(74) *Attorney, Agent, or Firm*—Nixon Peabody LLP; Donald R. Studebaker

(57) ABSTRACT

Disclosed is a dimmable fluorescent lamp operating apparatus which comprises a fluorescent lamp, electrical characteristic detecting element for detecting an electrical characteristic of the fluorescent lamp, an inverter circuit for driving the fluorescent lamp, and a feedback controlling circuit for controlling the drive frequency of the inverter circuit such that the electrical characteristic of the fluorescent lamp becomes a predetermined value, wherein the feedback controlling circuit includes temperature detecting element for detecting the temperature of the fluorescent lamp and wherein the frequency characteristic bandwidth of the feedback controlling circuit is varied based on the detected fluorescent lamp temperature.

7 Claims, 6 Drawing Sheets

FLUORESCENT LAMP OPERATING APPARATUS AND COMPACT SELF-BALLASTED FLUORESCENT LAMP

BACKGROUND OF THE INVENTION

The present invention relates to a fluorescent lamp operating apparatus and to a compact self-ballasted fluorescent lamp. The present invention relates more specifically to a dimmable fluorescent lamp operating apparatus and to a dimmable compact self-ballasted fluorescent lamp.

Fluorescent lamps have several advantages over incandescent lamps. For example, fluorescent lamps provide high efficiency operation and longer life. Because of these advantages, fluorescent lamps have been used extensively as luminaires for household use. In a typical technique of accomplishing the dimming of a fluorescent lamp, either the lamp current or lamp power is adjusted with a reference signal so as to control (dim) the brightness of the fluorescent lamp. More concretely, either the detection of a lamp current or lamp power is conducted and the switching frequency of the inverter circuit is feedback controlled so that the detected value becomes a predetermined lamp current or lamp power. An example of a lamp operating apparatus with such dimming capability is disclosed in JP Kokai Publication No. H09-204989.

According to such a published lamp operating apparatus, a signal proportional to the lamp power and a reference signal are subjected to comparison operation by an OP amplifier and based on a result of the comparison operation, the switching frequency of the inverter circuit is feedback controlled. As the switching frequency increases, the lamp power is reduced. As a result, the brightness of the fluorescent lamp decreases. On the other hand, as the switching frequency decreases, the lamp power increases. As a result, the brightness of the fluorescent lamp increases. At this time, the frequency characteristic bandwidth of the feedback controlling circuit for control of the lamp power is switched as follows. That is, when the lamp power is relatively small, the frequency characteristic bandwidth is made wider. On the other hand, when the lamp power is relatively great, the frequency characteristic bandwidth is made narrower. In other words, the frequency characteristic bandwidth of the feedback controlling circuit is varied depending upon the lamp power. The reason for this is to compensate unstable operation (oscillation) of the feedback controlling circuit, thereby to accomplish stable lamp dimming control from a high to a low lamp power state.

It is generally known in the art that discharge lamps, such as fluorescent lamps, gradually vary in their lamp characteristic (e.g., the electrical characteristic) during the transition to such a state that the temperature has become stable. Because of this, when a fluorescent lamp is turned on using a conventional circuit configuration of the type describe above, the following may occur. For example, in one case, it is possible to satisfactory accomplish lamp dimming control when the fluorescent lamp is sufficiently heated up to its high temperature state, while it is difficult to accomplish lamp dimming control when the fluorescent lamp is placed still in its low temperature state, and conversely, in another case, it is difficult to accomplish lamp dimming control when the fluorescent lamp is sufficiently heated up to its high temperature state, while on the other hand it is possible to satisfactory accomplish lamp dimming control when the fluorescent lamp is placed still in its low temperature state and consequently the feedback controlling circuit may become unstable in operation or generate oscillation because of the difference in lamp characteristic between the high temperature state and the low temperature state. Particularly, when the lamp power is small and the lamp temperature is low or when the lamp power is great and the lamp temperature is low, the feedback controlling circuit is likely to become unstable in operation or generate oscillation. Such lamp unstable operation (oscillation) may cause lamp flicker or produce some inconvenience (circuit failure in the worst case).

Bearing in mind the above problems with the prior art techniques, the present invention was made. Accordingly, a major object of the present invention is to provide a fluorescent lamp operating apparatus and a compact self-ballasted fluorescent lamp capable of accomplishing stable lamp dimming control, regardless of the temperature of the fluorescent lamp.

SUMMARY OF THE INVENTION

The present invention provides a dimmable fluorescent lamp operating apparatus which comprises a fluorescent lamp, electrical characteristic detecting means for detecting an electrical characteristic of the fluorescent lamp, an inverter circuit for driving the fluorescent lamp, and a feedback controlling circuit for controlling the drive frequency of the inverter circuit such that the electrical characteristic of the fluorescent lamp becomes a predetermined value, wherein the feedback controlling circuit includes temperature detecting means for detecting the temperature of the fluorescent lamp and wherein the frequency characteristic bandwidth of the feedback controlling circuit is varied based on the detected fluorescent lamp temperature.

In an embodiment of the present invention, the feedback controlling circuit has functions such that when the detected fluorescent lamp temperature is relatively high, the frequency characteristic bandwidth is made narrower, while when the detected fluorescent lamp temperature is relatively low, the frequency characteristic bandwidth is made wider.

It is preferred that the temperature detecting means be a thermally sensitive resistance element.

The present invention provides a compact self-ballasted fluorescent lamp comprising a fluorescent lamp, a ballast circuit, and a base wherein the fluorescent lamp is integrally formed with the ballast circuit and the base which are electrically connected to the fluorescent lamp. The ballast circuit comprises electrical characteristic detecting means for detecting an electrical characteristic of the fluorescent lamp, an inverter circuit for driving the fluorescent lamp, and a feedback controlling circuit for controlling the drive frequency of the inverter circuit such that the electrical characteristic of the fluorescent lamp becomes a predetermined value, wherein the feedback controlling circuit includes temperature detecting means for detecting the temperature of the fluorescent lamp and wherein the frequency characteristic bandwidth of the feedback controlling circuit is varied based on the detected fluorescent lamp temperature.

In an embodiment of the present invention, the feedback controlling circuit has functions such that when the detected fluorescent lamp temperature is relatively high, the frequency characteristic bandwidth is made narrower, while when the detected fluorescent lamp temperature is relatively low, the frequency characteristic bandwidth is made wider.

It is preferred that the temperature detecting means be a thermally sensitive resistance element.

Preferably, the thermally sensitive resistance element is so disposed as to be spaced at least 10 mm apart from a tube end at which an electrode of the fluorescent lamp is sealed.

DESCRIPTION OF PREFERRED EMBODIMENTS

Figure 1:
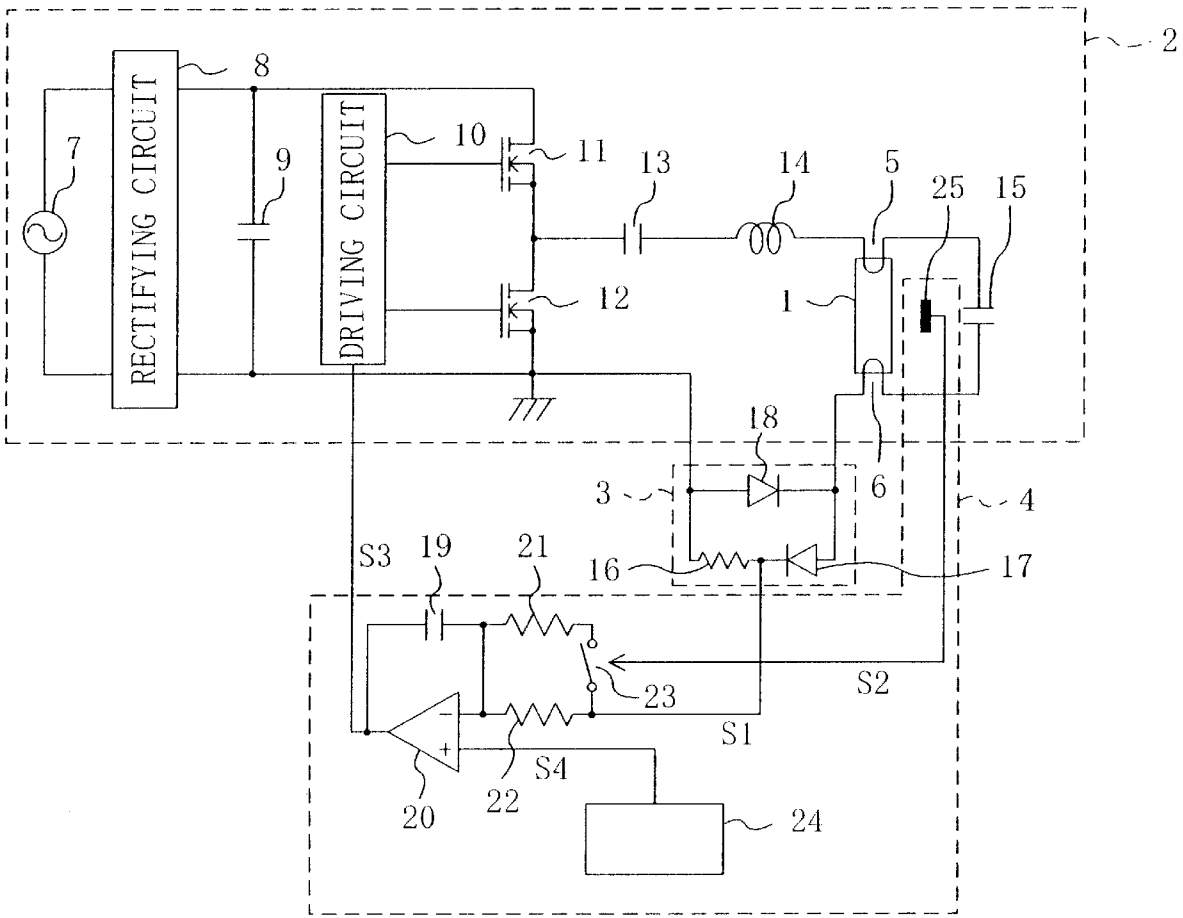
FIG. 1 is a diagram showing the structure of a fluorescent lamp operating apparatus according to a first embodiment of the present invention.

The present invention provides a fluorescent lamp operating apparatus comprising a feedback controlling circuit which controls the drive frequency of an inverter circuit such that the electric characteristic of the fluorescent lamp becomes a predetermined value. The feedback controlling circuit varies in frequency characteristic bandwidth according to the temperature of the fluorescent lamp detected by temperature detecting means. The frequency characteristic bandwidth of the feedback controlling circuit can be made narrower when the temperature of the fluorescent lamp is high, while on the other hand when the temperature of the fluorescent lamp is low, the frequency characteristic bandwidth of the feedback controlling circuit can be made wider. This makes it possible to prevent unstable operation (oscillation) of the feedback controlling circuit. Such frequency characteristic bandwidth control accomplishes stable lamp dimming control over a wide range from a low temperature state immediately after the fluorescent lamp is turned on to a high temperature state in which the temperature of the fluorescent lamp is sufficiently high.

Hereinafter, embodiments of the present invention will be explained with reference to the drawings. In the drawings, components having substantially the same function will be referred to by the same reference numeral for the sake of providing a simplified description of the present invention.

The present invention will not be limited to the following embodiments.

EMBODIMENT 1

Figure 2:
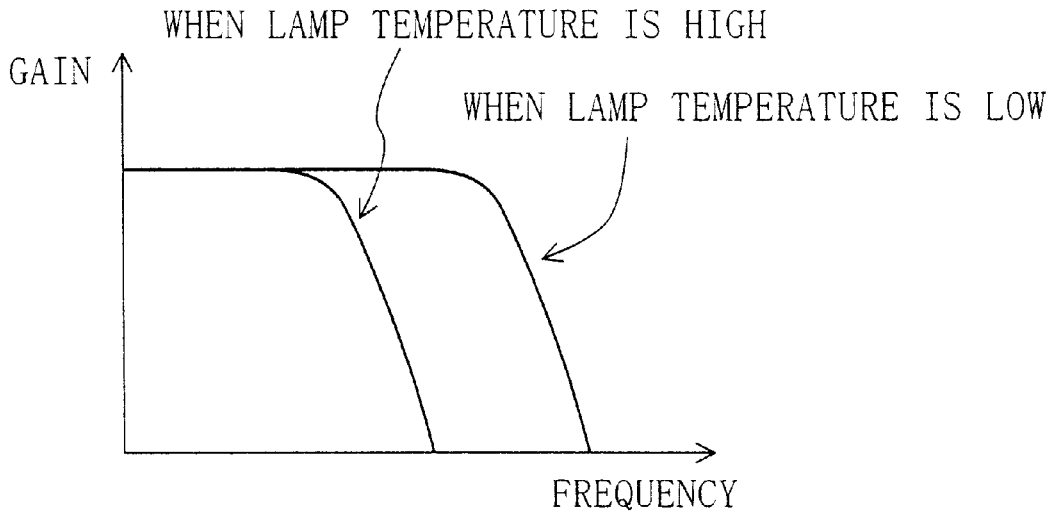
FIG. 2 graphically represents frequency bands at a high lamp-temperature state and at a low lamp-temperature state, respectively.

Referring to FIGS. 1 and 2, a fluorescent lamp operating apparatus formed in accordance with a first embodiment of the present invention will be explained. FIG. 1 shows the construction of the fluorescent lamp operating apparatus of the present embodiment.

The fluorescent lamp operating apparatus shown in FIG. 1 is a fluorescent lamp operating apparatus with dimming capability. The fluorescent lamp operating apparatus comprises a fluorescent lamp 1 having filament electrodes 5 and 6, an electrical characteristic detecting means 3 for detecting the electrical characteristic of the fluorescent lamp 1, an inverter circuit 2 for driving the fluorescent lamp 1, and a feedback controlling circuit 4 for controlling the drive frequency of the inverter circuit 2 such that the electrical characteristic of the fluorescent lamp 1 becomes a predetermined value. In the present embodiment, the feedback controlling circuit 4 controls the drive frequency of the inverter circuit 2 such that the electrical characteristic of the fluorescent lamp 1 (for example, the lamp power or lamp current ) becomes a setpoint at which a set dimming level is accomplished. Further, the feedback controlling circuit 4 includes a temperature detecting (sensing) means 25 for detecting the temperature of the fluorescent lamp 1. The feedback controlling circuit 4 has a function of varying in frequency characteristic bandwidth according to the temperature of the fluorescent lamp 1 detected (sensed) by the temperature detecting (sensing) means 25.

The inverter circuit 2 of the present embodiment comprises a commercial alternating current (ac) power supply 7, a rectifying circuit 8, capacitors 9, 13, and 15, a driving circuit 10, field-effect transistors (FETs) 11 and 12, and a choke coil 14. The commercial ac power supply 7 supplies an alternating current which is then converted into a direct current by the rectifying circuit 8 and the capacitor 9. The direct current is converted into a high frequency alternating current by alternately turning on and off the FETs 11 and 12. Thereafter, the high frequency alternating current thus converted is supplied, through a series resonance circuit made up of the choke coil 14 and the capacitors 13 and 15, to the fluorescent lamp 1. In other words, an alternate current from the commercial ac power supply 7 is supplied to the fluorescent lamp 1 in the form of high frequency ac power. The FETs 11 and 12 are driven by the driving circuit 10.

The electrical characteristic detecting means 3 is made up of a resistor 16 and diodes 17 and 18. The electrical characteristic detecting means 3 sends to the feedback controlling circuit 4 a signal proportional to the lamp current.

The feedback controlling circuit 4 is made up of a capacitor 19, an OP amplifier 20, resistors 21 and 22, a switch element 23, a reference signal generating circuit 24, and a temperature detecting means 25. In the feedback controlling circuit 4, comparison operation is performed on two signals, i.e, a signal S1 from the electrical characteristic detecting means 3 and a signal S4 from the reference signal generating circuit 24 by an arithmetic circuit network made up of the capacitor 19, the OP amplifier 20, the resistors 21 and 22, and the switch element 23 and a result of the comparison operation is fed to the driving circuit 10. Based on an output signal S3 from the feedback controlling circuit 4, the driving circuit 10 controls the drive frequency of the FETs 11 and 12.

Generally, when performing feedback control with an OP amplifier, unstable operation (oscillation) has been known to occur, unless the frequency characteristic bandwidth of the OP amplifier is set to an adequate value. When controlling the fluorescent lamp 1 as a load, the frequency characteristic bandwidth of the feedback controlling circuit 4 should be wide (the wider the better) if the temperature of the fluorescent lamp 1 is low, while on the other hand the frequency characteristic bandwidth of the feedback controlling circuit 4 should be narrow (the narrower the better) if the temperature of the fluorescent lamp 1 is sufficiently high, as shown in FIG. 2. The reason of why such arrangement is preferable may be that since the fluorescent lamp 1 is relatively unstable in its behavior when the temperature thereof is low, it is necessary to perform some degree of fast following control.

The frequency characteristic bandwidth of the feedback controlling circuit 4 is switched by the switch element 23 according to the temperature of the fluorescent lamp 1. The temperature of the fluorescent lamp 1 immediately after the fluorescent lamp 1 is turned on is about room temperature (for example, 25 degrees centigrade) and thereafter the fluorescent lamp temperature gradually increases up to about 70 degrees centigrade. The temperature of the fluorescent lamp 1 is detected by the temperature detecting means 25. The temperature detecting means 25 can be implemented by a device such as a thermocouple. In response to an output signal S2 from the temperature detecting means 25, the feedback controlling circuit 4 controls the switch element 23 to turn on when the temperature of the fluorescent lamp 1 is below a predetermined temperature (for example, 40 degrees centigrade). On the other hand, when the fluorescent lamp temperature is the predetermined temperature or above, the feedback controlling circuit 4 controls the switch element 23 to turn off.

When the temperature of the fluorescent lamp 1 is low and in addition the switch element 23 is turned on, the frequency characteristic bandwidth of the feedback controlling circuit 4 is determined by the capacitor 19 and the resistors 21 and 22. On the other hand, when the temperature of the fluorescent lamp 1 is high and in addition the switch element 23 is turned off, the frequency characteristic bandwidth of the feedback controlling circuit 4 is determined by the capacitor 19 and the resistor 22. The time constant, $\tau 1$, calculated by the capacitor 19 and the resistors 21 and 22 when the switch element 23 is placed in the on state, is smaller than the time constant, $\tau 2$, calculated by the capacitor 19 and the resistor 22 when the switch element 23 is placed in the off state. In other words, the frequency characteristic bandwidth of the feedback controlling circuit 4 becomes wider when the temperature of the fluorescent lamp 1 is low and the switch element 23 is placed in the on state than when the temperature of the fluorescent lamp 1 is high and the switch element 23 is placed in the off state. In the way described above, the frequency characteristic bandwidth of the feedback controlling circuit 4 is made narrower when the temperature of the fluorescent lamp 1 is relatively high, while on the other hand, the frequency characteristic bandwidth is made wider when the temperature of the fluorescent lamp 1 is relatively low.

The feedback controlling circuit 4 of the present embodiment has the reference signal generating circuit 24 which generates the reference signal S4 representative of a setpoint of the lamp current. This reference signal S4 is used to accomplish a desired dimming level. Since there is substantially a proportional relationship between the lamp current and the brightness, this makes it possible to accomplish brightness control or lamp dimming control by controlling the lamp current. For example, if the reference signal S4 is set high, then the output signal S3 becomes low. As a result, the driving circuit 10 reduces the switching frequency thereby to increase the brightness of the fluorescent lamp 1.

Next, the operation of the fluorescent lamp operating apparatus in accordance with the present embodiment will be explained.

Upon the turning on of the power supply (not shown in the figure), the filament electrodes 5 and 6 are preheated. Next, the capacitor 15 generates a high voltage with the filament electrodes 5 and 6 heated up to a state capable of emission of thermoelectrons and the fluorescent lamp 1 turns on.

Next, when the fluorescent lamp 1 turns on, the electrical characteristic detecting means 3 detects a signal proportional to the lamp current for forwarding to the feedback controlling circuit 4. In the present embodiment, the signal S1, half-wave rectified by the diodes 17 and 18, is applied to the feedback controlling circuit 4. In the feedback controlling circuit 4, the output signal S1 from the electrical characteristic detection circuit 3 and the output signal S4 from the reference signal generating circuit 24 are subjected to comparison operation in the OP amplifier 20 and the feedback controlling circuit 4 sends to the driving circuit 10 a signal used for control of the switching frequency of the FETs 11 and 12 to obtain a desired lamp current setpoint, i.e., a desired lamp brightness level.

After the fluorescent lamp 1 is turned on, the temperature of the fluorescent lamp 1 gradually increases. Firstly, the operation when the temperature of the fluorescent lamp 1 is still low (below 40 degrees centigrade) will be explained.

As described above, in order to accomplish stable lamp dimming control when the temperature of the fluorescent lamp 1 is low, it is preferable that the frequency characteristic bandwidth of the feedback controlling circuit 4 is made wider. The temperature detecting means 25 detects the temperature of the fluorescent lamp 1 and when the fluorescent lamp temperature is detected to be below 40 degrees centigrade, the switch element 25 is then placed in the on state. Since the switch element 25 is placed in the on state, the frequency characteristic bandwidth of the feedback controlling circuit 4 is set wider. Accordingly, even when the output signal of the reference signal generating circuit 24 is varied to adjustably control the brightness of the lamp, it is possible to accomplish stable lamp dimming control over a wide range without the occurrence of unstable operation (oscillation) in the feedback controlling circuit 4.

Next, the operation when the temperature of the fluorescent lamp 1 becomes substantially stable (about 70 degrees centigrade) will be described. When the temperature of the fluorescent lamp 1 becomes stable, the lamp electric characteristic likewise becomes stable. At this time, if the frequency characteristic bandwidth of the feedback controlling circuit 4 is too wide, then the feedback controlling circuit 4 reacts excessively to extra high frequency components, therefore resulting in the occurrence of unstable operation (oscillation) in the feedback controlling circuit 4. As a result of such occurrence, it becomes impossible to accomplish stable lamp dimming control. That is to say, as explained above, in order to accomplish stable lamp dimming control when the temperature of the fluorescent lamp 1 is sufficiently high, the frequency characteristic bandwidth of the feedback controlling circuit 4 should be relatively narrow.

When the temperature of the fluorescent lamp 1 is gradually increasing after the turning on of the fluorescent lamp 1, the temperature detecting means 25 places the switch element 23 in the off state the moment the temperature of the fluorescent lamp 1 becomes 40 degrees centigrade or above. Since the switch element 23 is placed in the off state, the frequency characteristic bandwidth of the feedback controlling circuit 4 is set narrower. Accordingly, even when the output signal of the reference signal generating circuit 24 is varied to adjustably control the brightness of the lamp, it is possible to accomplish stable lamp dimming control over a wide range without the occurrence of unstable operation (oscillation) in the feedback controlling circuit 4.

The fluorescent lamp operating apparatus of the present embodiment comprises the fluorescent lamp 1 having the filament electrodes 5 and 6, the inverter circuit 2 for operating the fluorescent lamp 1, the electrical characteristic detection circuit 3 for detecting the lamp current of the fluorescent lamp 1, and the feedback controlling circuit 4 for controlling the drive frequency of the inverter circuit 2 so that the lamp current becomes a predetermined value, wherein the frequency characteristic bandwidth of feedback controlling circuit 4 is switched according to the temperature of the fluorescent lamp 1, thereby making it possible to accomplish stable lamp dimming control over a wide range from a state in which the temperature of the fluorescent lamp 1 is still low because the fluorescent lamp 1 is just turned on to a state in which the temperature of the fluorescent lamp 1 is sufficiently high, without the occurrence of unstable operation (oscillation) in the feedback controlling circuit 4.

EMBODIMENT 2

A fluorescent lamp operating apparatus in accordance with a second embodiment will be explained by making reference to FIG. 3.

Figure 3:
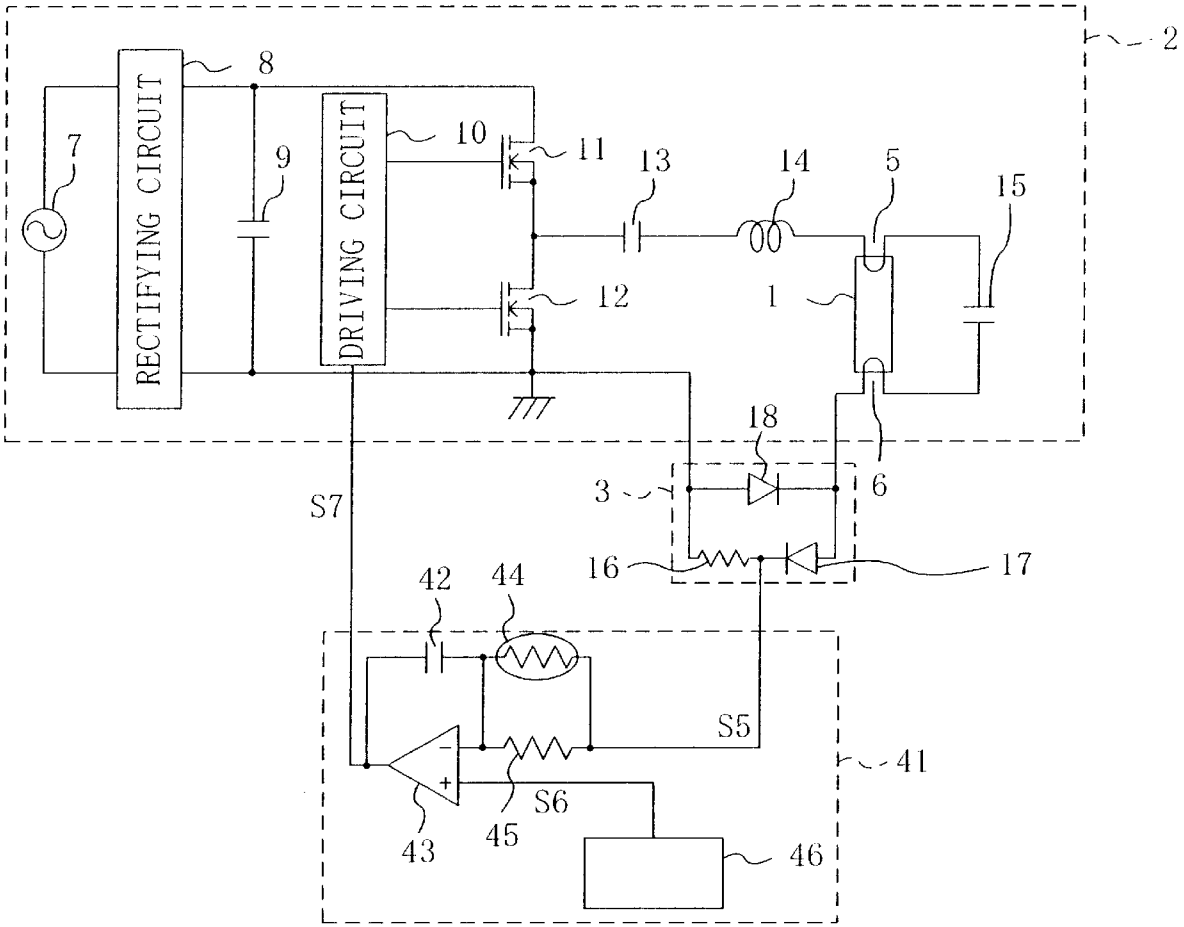
FIG. 3 is a diagram showing the structure of a fluorescent lamp operating apparatus according to a second embodiment of the present invention.

FIG. 3 shows the structure of the fluorescent lamp operating apparatus of the present embodiment. The fluorescent lamp operating apparatus of the present embodiment differs from the fluorescent lamp operating apparatus of the first embodiment in having a feedback controlling circuit 41 with a thermally sensitive resistance element 44 acting as temperature detecting means. Since the fluorescent lamp 1, the inverter circuit 2, and the electrical characteristic detection circuit 3 of the present embodiment are the same as in the first embodiment, their description will be omitted accordingly. Hereinafter, different points of the present embodiment from the first embodiment will be described in detail.

The fluorescent lamp operating apparatus of the present embodiment has, in place of the feedback controlling circuit 4 of the first embodiment, a feedback controlling circuit 41 made up of a capacitor 42, an OP amplifier 43, a thermally sensitive resistance element 44, a resistor 45, and a reference signal generating circuit 46. In the feedback controlling circuit 41, a signal S5 from the electrical characteristic detection circuit 3 and a signal S6 from the reference signal generating circuit 46 are subjected to comparison operation in an arithmetic circuit network made up of the capacitor 42, the OP amplifier 43, the thermally sensitive resistance element 44, and the resistor 45 and a result of the comparison operation (an output signal S7) is provided to the driving circuit 10.

The thermally sensitive resistance element 44 exhibits a positive temperature characteristic. The thermally sensitive resistance element 44 is an element whose value of resistance is several hundreds of ohms at room temperature (at 25 degrees centigrade). However, when the temperature of the thermally sensitive element 44 is increased to exceed a predetermined temperature, the resistance value will rapidly increase. The present embodiment employs, as the thermally sensitive resistance element 44, a PTC thermistor which exhibits different resistance values of 470 Ω at 25° C., 470 Ω at 40° C., and 1.5 kΩ at 70° C. The thermally sensitive resistance element 44 is typically small in dimensions. This provides a great advantage that the packaging area of the thermally sensitive resistance element 44 is small. The present embodiment uses, as the thermally sensitive resistance element 44, a PTC thermistor the length of which sides is about 1.6 mm.

The frequency characteristic bandwidth of the feedback controlling circuit 41 is determined by the capacitor 42, the thermally sensitive resistance element 44, and the resistor 45. Since the resistance value of the thermally sensitive resistance element 44 varies depending on the temperature, the frequency characteristic bandwidth of the feedback controlling circuit 41 varies depending on the temperature. In other words, when the temperature is low, the resistance value of the thermally sensitive resistance element 44 is low. Consequently, the frequency characteristic bandwidth of the feedback controlling circuit 41 becomes wider. On the other hand, when the temperature is high, the resistance value of the thermally sensitive resistance element 44 is high. Consequently, the frequency characteristic bandwidth of the feedback controlling circuit 41 becomes narrower.

Figure 4:
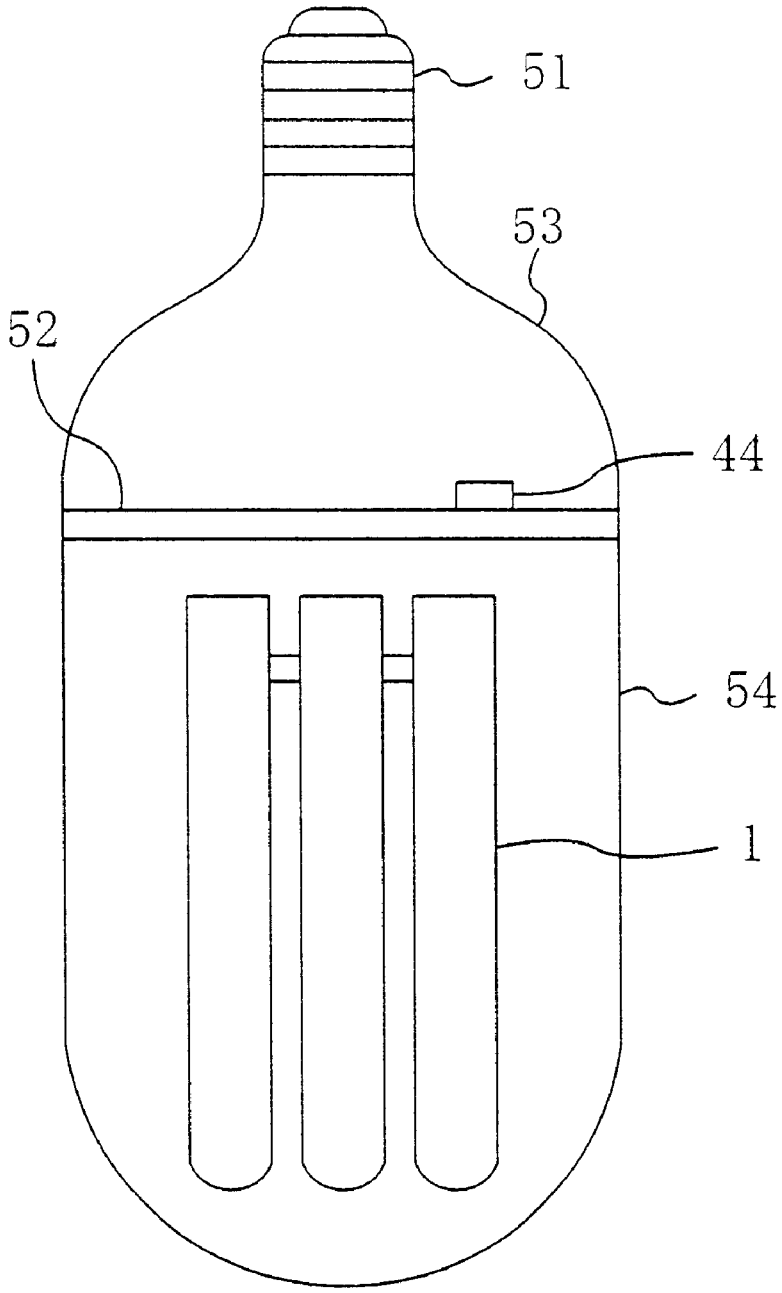
FIG. 4 is a diagram schematically depicting the structure of a compact self-ballasted fluorescent lamp according to the second embodiment of the present invention.

The fluorescent lamp operating apparatus of the present embodiment can be constructed in the form of a compact self-ballasted fluorescent lamp. FIG. 4 schematically shows the fluorescent lamp operating apparatus of the present embodiment embodied as a compact self-ballasted fluorescent lamp.

The compact self-ballasted fluorescent lamp shown in FIG. 4 comprises a fluorescent lamp 1 formed of three substantially U-shaped arch tubes joined together by a bridge, a base 51 such as an incandescent lamp E26 type base, a circuit board 52 on which a pattern of the ballast circuit of FIG. 2 is formed and onto which individual circuit parts are attached, a cover 53 attached, at its one end, to the base 51 and housing therein the circuit board 52, and a translucent globe 54 arranged so as to enclose the fluorescent lamp 1.

Although not shown in the figure, there are established electrical connection between the fluorescent lamp 1 and the circuit board 52 and between the circuit board 52 and the base 51. When the base 51 is screwed into an incandescent lamp socket, electric power is supplied from a commercial power supply through the base 51 to turn on the fluorescent lamp 1. Although the various circuit parts are mounted on the circuit board 52, only the thermally sensitive resistance element 44 is shown in the figure.

Figure 5:
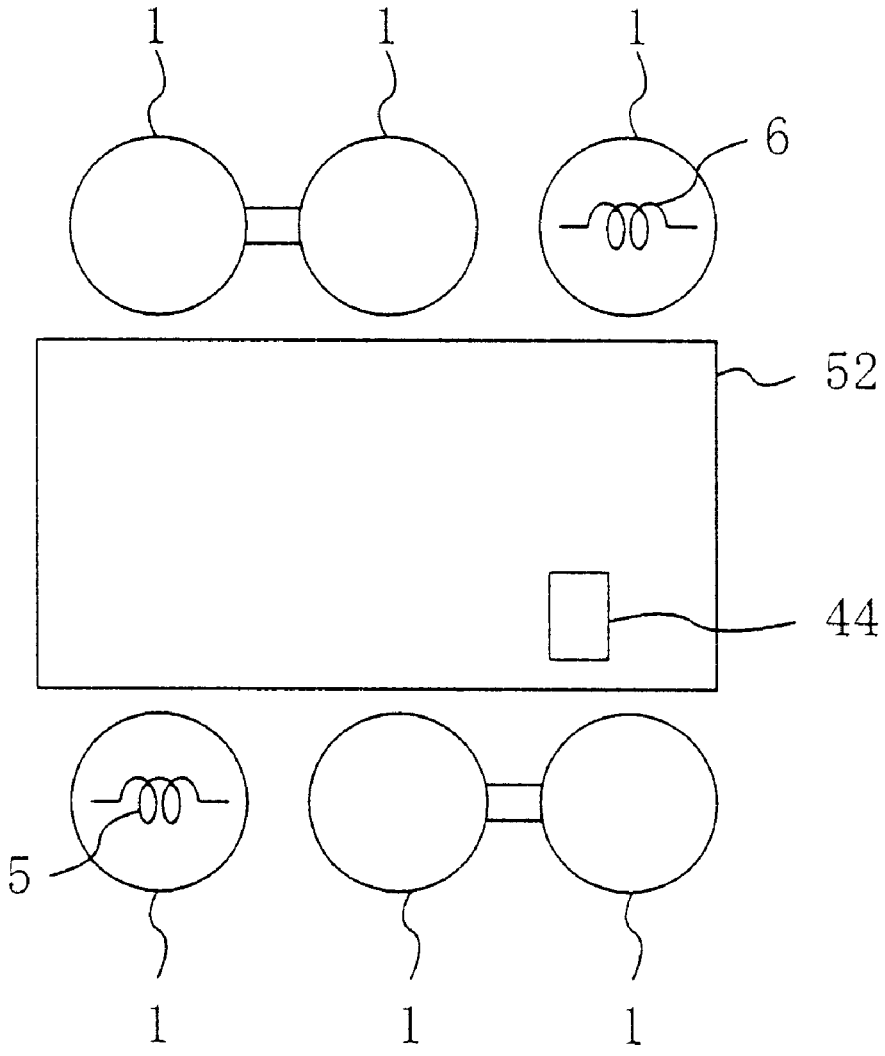
FIG. 5 is a top plan view indicating the placement location of a thermally sensitive resistance element 44.

As shown in FIG. 5, the thermally sensitive resistance element 44 is disposed a distance of at least 10 mm from electrodes 5 and 6 of the fluorescent lamp 1. The reason for such separation is to protect these electrodes 5 and 6 from the influence of temperature because the temperature in the vicinity of the electrodes 5 and 6 of the fluorescent lamp 1 is extremely high (about 800 degrees centigrade).

Next, the operation of the fluorescent lamp operating apparatus (or the compact self-ballasted fluorescent lamp) of the present embodiment will be explained. Since the operation up to the time that the fluorescent lamp 1 is turned on is the same as in the first embodiment, the description thereof will be omitted accordingly.

Upon the turning on of the fluorescent lamp 1, the electrical characteristic detecting means 3 detects and sends a signal proportional to the lamp current to the feedback controlling circuit 41. In the present embodiment, the signal S5, half-wave rectified in the diodes 17 and 18, is applied to the feedback controlling circuit 41. In the feedback controlling circuit 41, the output signal S5 from the electrical characteristic detection circuit 3 and an output signal S6 from the reference signal generating circuit 46 are subjected to comparison operation in the OP amplifier 43 and the feedback controlling circuit 41 sends to the driving circuit 10 a signal S7 used for control of the switching frequency of the FETs 11 and 12 to obtain a desired lamp current setpoint, or a desired brightness level.

In the case the fluorescent lamp operating apparatus of the present invention is embodied in the form of a compact self-ballasted fluorescent lamp, the fluorescent lamp 1 and the circuit board 52 are integral with each other. Therefore, the fluorescent lamp 1 and the circuit board 52 are disposed extremely proximately to each other. Accordingly, the circuit board 52 is influenced by heat radiated from the fluorescent lamp 1 and therefore the temperature of the circuit board 52 is substantially proportional to that of the fluorescent lamp 1. That is to say, as the temperature of the fluorescent lamp 1 gradually increases after it is turned on, the temperature of the circuit board 52 likewise increases. In other words, the temperature of the circuit board 52 is low immediately after the fluorescent lamp 1 is turned on but thereafter gradually increases.

Firstly, the operation when both the temperature of the fluorescent lamp 1 and the temperature of the circuit board 52 are low (below 40 degrees centigrade) will be explained. As described above, in order to accomplish stable lamp dimming control when the temperature of the fluorescent lamp 1 is low, the frequency characteristic bandwidth of the feedback controlling circuit 41 should be wide, and the wider the better. When the temperature of the circuit board 52 is low, the temperature of the thermally sensitive resistance element 44 is also low and therefore the resistance value of the thermally sensitive resistance element 44 is low. Consequently, the frequency characteristic bandwidth of the feedback controlling circuit 41 becomes wider. Accordingly, even when the output signal of the reference signal generating circuit 46 is varied to adjustably control the brightness of the lamp, it is possible to accomplish stable lamp dimming control over a wide range without the occurrence of unstable operation (oscillation) in the feedback controlling circuit 41.

Next, the operation when the temperature of the fluorescent lamp 1 becomes substantially stable (about 70 degrees centigrade) will be explained. As described above, in order to accomplish stable lamp dimming control when the temperature of the fluorescent lamp 1 is high, the frequency characteristic bandwidth of the feedback controlling circuit 41 should be narrow, and the narrower the better. When the temperature of the circuit board 52 is high, the temperature of the thermally sensitive resistance element 44 is likewise high, and therefore the resistance value of the thermally sensitive resistance element 44 is high. Consequently, the frequency characteristic bandwidth of the feedback controlling circuit 41 becomes narrower. Accordingly, even when the output signal of the reference signal generating circuit 46 is varied to adjustably control the brightness of the lamp, it is possible to accomplish stable lamp dimming control over a wide range without the occurrence of unstable operation (oscillation) in the feedback controlling circuit 41.

Figure 6:
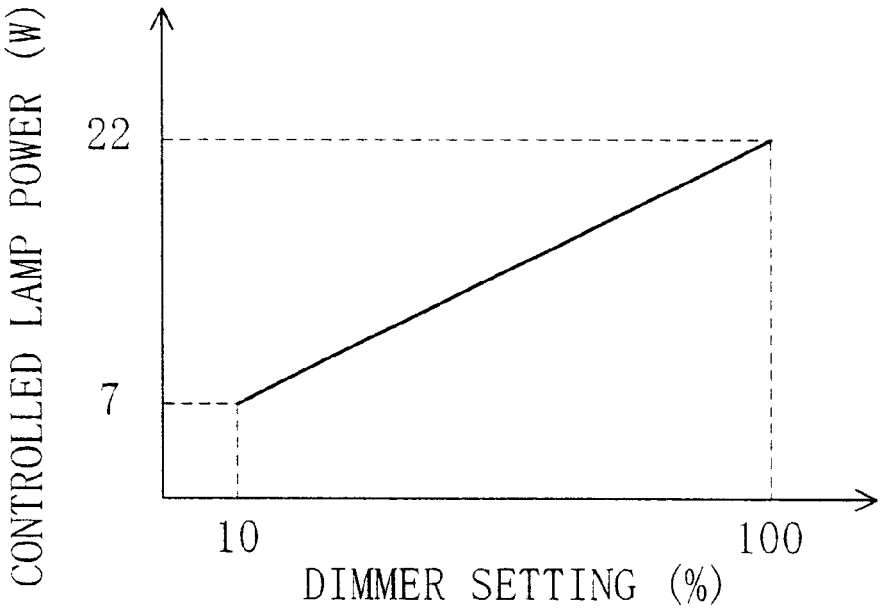
FIG. 6 graphically shows a relationship between the setting of a dimmer and the lamp power to be controlled.

When adjustably controlling (dimming) the brightness of the compact self-ballasted fluorescent lamp (the fluorescent lamp operating apparatus) of the present embodiment, for example, such lamp dimming control may be carried out by the use of a dimmer installed in a wall of the room where the lamp is installed or by the use of a remote control dimmer. In the compact self-ballasted fluorescent lamp of the present embodiment, as shown in FIG. 6, the controlling of lamp power is carried out as follows. For example, when the setting of the dimmer is set at a level of 100%, a lamp power of 22 watts is supplied and when the dimmer setting is set at a level of 10%, a lamp power of 7 watts is supplied. The experiments conducted by the inventor of the present invention show that it is possible to adjustably control the brightness of the compact self-ballasted fluorescent lamp of the present embodiment in a stable manner when the lamp power is great while the lamp temperature is low or high as well as when the lamp power is small while the lamp temperature is low or high.

The fluorescent lamp operating apparatus of the present embodiment comprises the fluorescent lamp 1 having the filament electrodes 5 and 6, the inverter circuit 2 for operating the fluorescent lamp 1, the electrical characteristic detecting means 3 for detection of the lamp current of the fluorescent lamp 1, and the feedback controlling circuit 41 for controlling the drive frequency of the inverter circuit 2 such that the lamp current comes to have a predetermined value, wherein by making utilization of the knowledge that the resistance value of the thermally sensitive resistance element 44 mounted on the circuit board 52 varies with changes in the temperature of the fluorescent lamp 1, the frequency characteristic bandwidth of the feedback controlling circuit 41 is switched. This makes it possible to accomplish stable lamp dimming control over a wide range from a state in which the temperature of the fluorescent lamp 1 is still low because the fluorescent lamp 1 is just turned on to a state in which the temperature of the fluorescent lamp 1 is sufficiently high, without the occurrence of unstable operation (oscillation) in the feedback controlling circuit 41.

Particularly, in the present embodiment, the frequency characteristic bandwidth of the feedback controlling circuit 41 is changed by the thermally sensitive resistance element (implemented by, for example, a PTC thermistor) 44. This provides a simpler circuit configuration as compared with the first embodiment. Further, the thermally sensitive resistance element 44 is spaced a distance of more than 10 mm apart from the electrodes 5 and 6, whereby the thermally sensitive resistance element 44 becomes unsusceptible to the temperature of the electrodes 5 and 6 thereby improving controllability.

In the foregoing first and second embodiments, the inverter circuit 2 is used as a circuit configuration to operate the fluorescent lamp 1. However, any other circuit configuration may be employed as long as it is able to operate the fluorescent lamp 1. Furthermore, in the foregoing embodiments, the electrical characteristic detecting means 3 is so configured as to detect a lamp current. However, any other signal can be detected as long as it is proportional to the brightness of the fluorescent lamp 1, e.g., a signal representative of a lamp power. However, in such a case, it is necessary to detect both a lamp current and a lamp voltage to calculate a lamp power. This results in requiring a complicated circuit configuration. Further, the lamp current is half-wave rectified and then detected. However, a lamp current may be full-wave rectified and then detected. However, in the latter case, the number of circuit parts will increase.

Although the frequency characteristic bandwidth of the feedback controlling circuit 4 is switched between two levels in the first embodiment, it may, of course, be switched among three levels or more. However, in such a case, the circuit configuration becomes more complicated than the 2-level switching.

In the second embodiment, the description of the fluorescent lamp 1 has been made in terms of a fluorescent lamp formed of three substantially U-shaped arch tubes linked together by a bridge. However, the fluorescent lamp 1 may be implemented by any other different shape, for example, a W-U shaped fluorescent lamp. However, if there is made a change in the shape of the fluorescent lamp 1, this causes the positions of the electrodes 5 and 6 to change. Accordingly, it is preferable that the placement location of the thermally sensitive resistance element 44 be changed to an adequate position. In the embodiment, the thermally sensitive resistance element 44 has a positive temperature characteristic but may have a negative temperature characteristic.

In the second embodiment, the base 51 is of the incandescent lamp E26 type. However, any other base of different shape may be employed. The description has been made in terms of a compact self-ballasted fluorescent lamp with the globe 54. However, it is needless to say that the presence or absence of the globe 54 is irrelevant. The fluorescent lamp operating apparatus of the first embodiment may be constructed in the form of a compact self-ballasted fluorescent lamp. Further, any one of the fluorescent lamp operating apparatuses of the first and second embodiments may be constructed into a conventional fluorescent lamp shape other than the compact self-ballasted fluorescent lamp shape.

In the present invention, because of the provision of the feedback controlling circuit whose frequency characteristic bandwidth is subject to change according to the temperature of the fluorescent lamp detected by the temperature detecting means, the frequency characteristic bandwidth of the feedback controlling circuit is so varied as to become narrower when the temperature of the fluorescent lamp is high, while the frequency characteristic bandwidth of the feedback controlling circuit is so varied as to become wider when the temperature of the fluorescent lamp is low. Because of this, it becomes possible to prevent the occurrence of unstable operation (oscillation) in the feedback controlling circuit. Accordingly, it is possible to provide a fluorescent lamp operating apparatus (or a compact self-ballasted fluorescent lamp) capable of accomplishing stable lamp dimming adjustments, regardless of the fluorescent lamp temperature.

What is claimed is:

1. A dimmable fluorescent lamp operating apparatus comprising:

a fluorescent lamp;

electrical characteristic detecting means for detecting an electrical characteristic of said fluorescent lamp;

an inverter circuit for driving said fluorescent lamp; and a feedback controlling circuit for controlling the drive frequency of said inverter circuit such that said electrical characteristic of said fluorescent lamp becomes a predetermined value;

wherein said feedback controlling circuit includes temperature detecting means for detecting the temperature of said fluorescent lamp and wherein the frequency characteristic bandwidth of said feedback controlling circuit is varied based on said detected fluorescent lamp temperature.

2. The fluorescent lamp operating apparatus of claim 1, wherein said feedback controlling circuit has functions such that when said detected fluorescent lamp temperature is relatively high, said frequency characteristic bandwidth is made narrower, while when said detected fluorescent lamp temperature is relatively low, said frequency characteristic bandwidth is made wider.

3. The fluorescent lamp operating apparatus of claim 1, wherein said temperature detecting means is a thermally sensitive resistance element.

4. A compact self-ballasted fluorescent lamp comprising a fluorescent lamp, a ballast circuit, and a base wherein said fluorescent lamp is integrally formed with said ballast circuit and said base which are electrically connected to said fluorescent lamp, said ballast circuit comprising:

electrical characteristic detecting means for detecting an electrical characteristic of said fluorescent lamp;

an inverter circuit for driving said fluorescent lamp; and a feedback controlling circuit for controlling the drive frequency of said inverter circuit such that said electrical characteristic of said fluorescent lamp becomes a predetermined value;

wherein said feedback controlling circuit includes temperature detecting means for detecting the temperature of said fluorescent lamp and wherein the frequency characteristic bandwidth of said feedback controlling circuit is varied based on said detected fluorescent lamp temperature.

5. The compact self-ballasted fluorescent lamp of claim 4, wherein said feedback controlling circuit has functions such that when said detected fluorescent lamp temperature is relatively high, said frequency characteristic bandwidth is made narrower, while when said detected fluorescent lamp temperature is relatively low, said frequency characteristic bandwidth is made wider.

6. The compact self-ballasted fluorescent lamp of claim 4, wherein said temperature detecting means is a thermally sensitive resistance element.

7. The compact self-ballasted fluorescent lamp of claim 6, wherein said thermally sensitive resistance element is so disposed as to be spaced at least 10 mm apart from a tube end at which an electrode of said fluorescent lamp is sealed.

* * * * *